United States Patent [19]

Honegger et al.

[11] 4,359,295

[45] Nov. 16, 1982

[54] EXPANSION JOINT MEMBER

[75] Inventors: Heinz Honegger, Wil; Franz Bauer, Winkel, both of Switzerland

[73] Assignee: Honel Holding AG, Ltd. SA, Switzerland

[21] Appl. No.: 220,117

[22] Filed: Dec. 24, 1980

[51] Int. Cl.[3] ..... E01C 11/04

[52] U.S. Cl. ..... 404/68; 52/396

[58] Field of Search ..... 404/69, 68, 65, 64, 404/47; 49/475; 52/396; 269/249

[56] References Cited

U.S. PATENT DOCUMENTS

| | | | |
|---|---|---|---|
| 167,314 | 8/1875 | Donley | 269/249 X |
| 3,904,303 | 9/1975 | Becht | 404/68 |
| 3,981,601 | 9/1976 | Arai | 52/396 |
| 4,111,583 | 9/1978 | Brady et al. | 404/69 |
| 4,245,925 | 1/1981 | Pyle | 404/69 X |

FOREIGN PATENT DOCUMENTS

| | | | |
|---|---|---|---|
| 241514 | 7/1965 | Austria | 404/68 |
| 2609759 | 9/1977 | Fed. Rep. of Germany | 404/69 |
| 1402196 | 5/1965 | France | 404/68 |
| 410034 | 10/1966 | Switzerland | 40/64 |
| 1434649 | 5/1926 | United Kingdom | 52/396 |
| 1108751 | 4/1968 | United Kingdom | 404/64 |

*Primary Examiner*—Nile C. Byers, Jr.
*Attorney, Agent, or Firm*—Thomas W. Speckman

[57] ABSTRACT

This invention relates to a device for spanning expansion gaps in bridge decks or roadways. The invention provides a small, simple and low cost edge channel member of U-shape which may be welded to one type or a variety of different commericially available steel sections in accordance with any particular needs. Screws accessible from above are provided to retain the edge portions of an elongate body of flexible resilient elastomeric material which spans the expansion gap. Thus, the invention permits the installation of expansion joints for any desired thickness of the wearing course and any type of fastening to the concrete base course.

5 Claims, 2 Drawing Figures

Fig.1
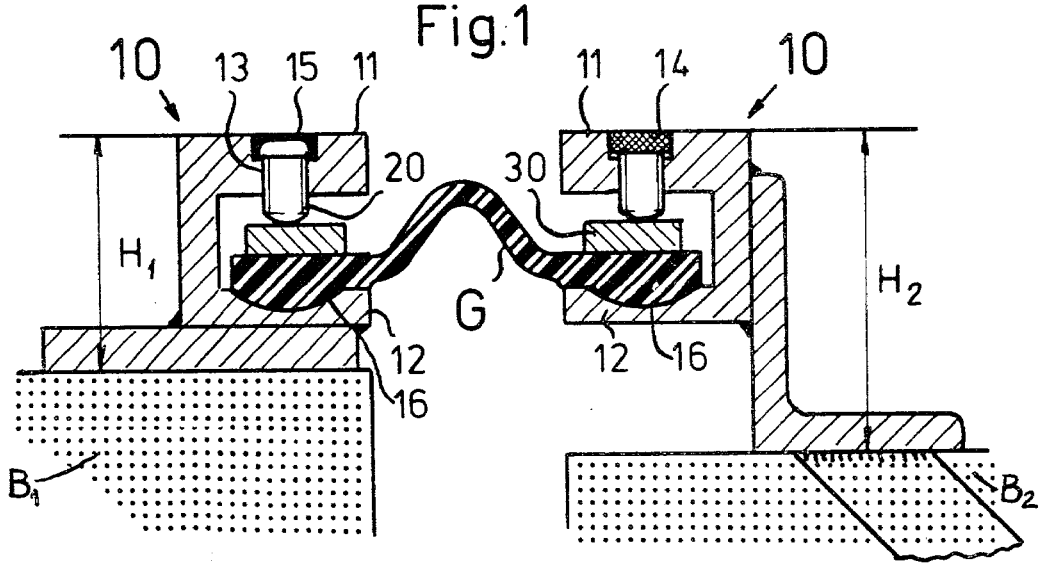
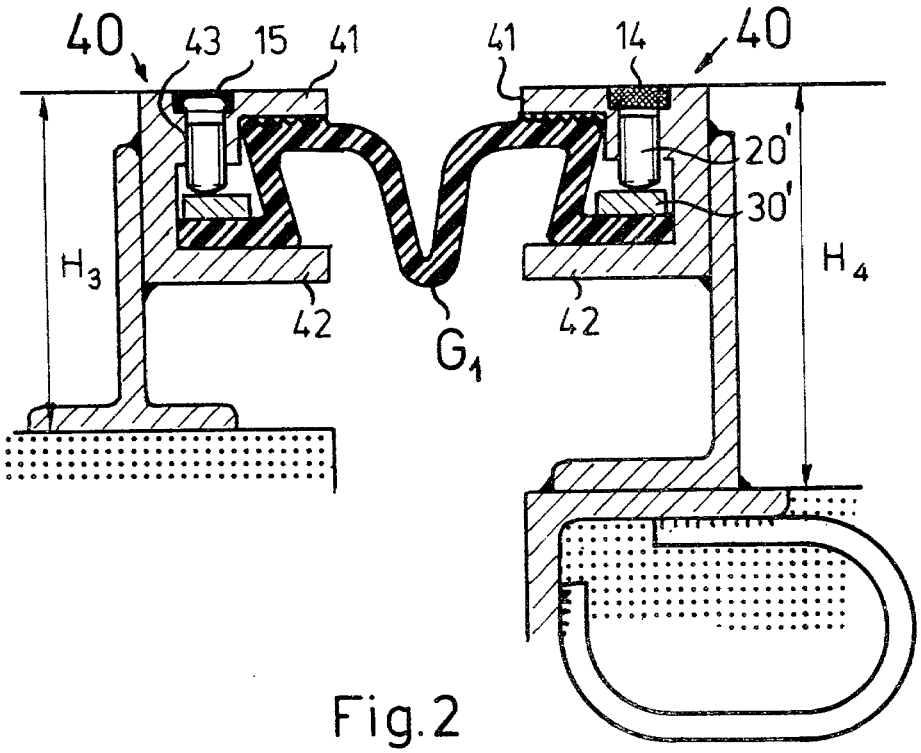
Fig.2

EXPANSION JOINT MEMBER

BACKGROUND OF THE INVENTION

1. Field of the Invention

This invention relates to a device for spanning expansion gaps in bridges or roadways with the upper edge of the device being flush with the roadway surface and defining its edge. Screws accessible from above are provided to retain the edge portions of an elongate body of flexible resilient elastomeric material which spans the expansion gap.

2. Description of the Prior Art

Conventional devices for covering expansion joints comprise one-piece metal edge channel members installed on each side of the expansion gap. Such edge members are generally made to order with a large cross section. The edge members are secured to the concrete base structure, whereby the thickness of the wearing course to be applied to the concrete base course is determined by the edge member. Layers of different thicknesses require edge channel members of different cross sections.

A device of this general type is disclosed, for instance, in Swiss Patent CH-PS 475,428. The disclosed device makes use of relatively large, one piece metal edge channels which are secured to the concrete base course near the edge of the gap. These edge channels or bars have a relatively large cross section and are rolled to order. Consequently, such sections are expensive. The particular cross-sectional configuration of the section must meet the thickness requirements of a bitumen wearing course to be applied to the concrete base course. A thicker or thinner wearing course, naturally, requires different cross sections.

SUMMARY OF THE INVENTION

It is an object of the present invention to provide an edge or seal locking channel member which is as small and as simple as possible, is inexpensive in its manufacture, and is adapted to be welded to one type or a variety of types of commercially available steel sections, dependent upon the desired thickness of the wear course and the intended mode of anchoring to the base course.

This object is achieved according to the present invention by an expansion joint comprising a metal edge or seal locking channel member having a substantially U-shaped cross section, the open side of the U facing the expansion gap. Disposed intermediate the two flanges of the edge member is a restraining bar. Screws threaded from the top through the upper flange exert pressure upon the restraining bar so that the edge portions of a resilient elongate body of elastomeric material are clamped between the upper surface of the lower flange and the restraining bar.

Since in this type of expansion joint dirt may enter into the hollow space defined between opposing edge members, it is to good advantage to close the space with sealing means in the form of a resilient elongate body of elastomeric material. In a preferred embodiment, the right hand edge portion of the elongate elastomeric member has a Z-shaped cross section while the left hand edge portion is a mirror image thereof. These edge portions are so dimensioned that in the installed condition the upper cross beam of the Z-shaped portion is in sealing engagement with the underside of the upper flange of the edge member, while the lower cross beam is retained by the restraining bar against the lower flange of the edge member.

BRIEF DESCRIPTION OF THE DRAWINGS

The invention will be described in further detail with reference to preferred embodiments illustrated in the drawings, in which:

FIG. 1 shows an embodiment of an expansion joint according to this invention in which the edge member has been welded to a flat bar as shown in the left half of the drawing and to a standard angle section as shown in the right half of the drawing; and FIG. 2 shows another embodiment of an expansion joint according to this invention utilizing an elongate resilient member of elastomeric material whose edge portions are Z-shaped.

DESCRIPTION OF THE PREFERRED EMBODIMENTS

The expansion joint illustrated in FIG. 1 makes use of a pair of edge or seal locking channel members 10 having a U-shaped cross section. The upper flange 11 of the edge member 10 is slightly thicker than the lower flange 12 in order to provide sufficient depth for helical screws 20. Threaded holes 13 for the screws 20 are uniformly spaced along the entire length of the edge members 10. Disposed intermediate the two flanges 11 and 12 is a metal restraining bar 30 having a rectangular cross section. The lower flange 12 is provided with a depression 16 to receive in a tightly fitting relationship a beaded rim or edge portion of an elongate resilient body G made of an elastomeric material. The threaded bores 13 are countersunk from the top and are covered by a plug 14 or a cap 15 of plastic material.

Disposed between the lower flange 12 and the restraining bar 30 is the edge portion of the resilient elongate member G. By tightening the screws 20, which may be the interior hex bolt type, the edge portions of the elongate resilient member G are urged and clamped in a sealing relationship against the upper surface of the lower flange 12.

By welding the edge channel members 10 to standardized steel sections with different cross sections, various combinations may be produced which permit various methods of anchoring or fastening the assembly to the concrete base course B1, B2 and which will result in providing different thicknesses H1, H2, of the wearing course. In the left hand side of FIG. 1, a rectangular straight bar has been used, while the right hand side of FIG. 1 illustrates the use of an angle section.

In the expansion joint illustrated in FIG. 1, the restrainer bar 30 is easy to install but it is possible for dirt to enter the space below the upper flange 11. The restrainer bar may be installed either simultaneously with the resilient elongate body G or at a later time. Likewise, the removal of the restrainer bar 30 can be accomplished without difficulty.

The embodiment of the invention shown in FIG. 2 overcomes the disadvantage of dirt entering the space between upper flange 11 and elongate body G by utilizing a resilient elongate body G1 whose rim or edge portion has a Z-shaped cross section. In the right hand side of the drawings, the edge portion is shown with its Z-shaped configuration, while the left hand side represents a mirror image thereof. By applying pressure, the upper cross beam portion of the Z-shaped portion is urged against the underside of the upper flange 41. The edge channel member 40 employed in this embodiment has stepped upper flange 41, the outwardly projecting portions of which are thinner than the portion adjacent the web joining the flanges.

The restraining bar 30' has a rectangular cross section. In the mounted condition, the screws 20' exert pressure upon the bar 30' so that the lower cross beam of the Z-shaped edge portion is clamped in sealing relationship upon the top surface of the lower flange 42. The threaded bores 43 are again countersunk, as in FIG. 1, and are covered by a plug 14 or a cap 15 of plastic material.

In FIG. 2, the edge channel members 40 are welded to different cross-sectional types of standard sections so that wearing surface thicknesses H3, H4 may be obtained.

The restrainer bar 30' may be loosely installed or may be fastened to the lower cross beam of the Z-shaped edge portion of the elongate resilient body G1. If the restrainer bar 30' is installed in a loose fashion, additional holes (not shown) may be provided in upper flange 41 between the threaded holes to enable the lifting and holding up of the restrainer bar 30', as by wires, during installation.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A device for spanning expansion gaps in bridge decks or roadways of the type having a base coarse and a wearing coarse wherein the upper edge of said device is flush with the surface of said wearing coarse and defines its edge on each side of said gap, said device comprising: opposing metal edge channel members (10, 40) having a substantially U-shaped cross section which is open toward the expansion gap having upper (11, 41) and lower (12, 42) flanges extending into said gap, the upper surface of said upper flanges flush with said surface of said wearing coarse and said upper flanges having spaced threaded through holes (13, 43), said channel members being anchored to said base coarse; an elongate elastomeric member (G, $G_1$) extending across said gap and into said channel members, said elastomeric member having a substantially flat edge portion on each side, said flat edge portion having its lower surface in contact with the upper surface of said lower flanges of said channel members; substantially flat restraining bars (30, 30') disposed between said upper flanges of said channel members and said elastomeric member; and screw means (20, 20') threadedly engaged from above through said threaded through holes and engaging the top of said restraining bars to clamp said flat edge portions of said elongate elastomeric member between the upper surface of said lower flanges of said channel members and said restraining bars.

2. A device according to claim 1, characterized in that the right hand edge portion of said elongate elastomeric member ($G_1$) has a Z-shaped cross section and the left hand edge portion is a mirror image thereof, the lower portion of said Z-shaped cross sections forming said substantially flat edge portions of said elastomeric member, the upper surface of the upper portions of said Z-shaped cross sections being in sealing engagement with the lower surface of said upper flanges of said edge channel members.

3. A device according to claims 1 or 2 characterized in that said flat restraining bars (30, 30') are fastened to the upper surface of said substantially flat edge portions of said elastomeric member.

4. A device according to claims 1 or 2 characterized in that said channel members (10, 40) height between said upper and lower flanges is less than the height of said wearing coarse and that said channel members are attached to a second metal shape for said anchoring to said base coarse.

5. A device according to claim 1 characterized in that the upper surface of said lower flange (12) has a depression (16) into which said restraining bars (30) force said flat edge portions of said elastomeric member.

* * * * *